United States Patent [19]

Kaminski et al.

[11] Patent Number: 4,462,809

[45] Date of Patent: Jul. 31, 1984

[54] METAL-CONTAINING PRODUCTS OF PHOSPHOSULFURIZED AMIDES AND LUBRICANTS CONTAINING SAME

[75] Inventors: Joan M. Kaminski, Clementon; Andrew G. Horodysky, Cherry Hill, both of N.J.

[73] Assignee: Mobil Oil Corporation, New York, N.Y.

[21] Appl. No.: 259,328

[22] Filed: Apr. 30, 1981

[51] Int. Cl.[3] ..... C10L 1/26; C10M 1/48

[52] U.S. Cl. ..... 44/67; 44/71; 252/32.7 E; 252/46.7

[58] Field of Search ..... 44/67, 71; 252/46.4, 252/46.7, 32.7 E

[56] References Cited

U.S. PATENT DOCUMENTS 2,562,904 8/1951 Freeman ..... 252/46.7
3,496,106 2/1970 Matson ..... 252/46.7
4,031,017 6/1977 Sabol ..... 252/46.7
4,293,432 10/1981 Papay et al. ..... 252/51.5 A

FOREIGN PATENT DOCUMENTS 578923 7/1959 Canada ..... 252/46.7

*Primary Examiner*—Jacqueline V. Howard
*Attorney, Agent, or Firm*—Alexander J. McKillop; Michael G. Gilman; Claude E. Setliff

[57] ABSTRACT

The invention herein is concerned with new compositions of matter made by (1) reacting phosphorus pentasulfide with an amide and (2) reacting this product with a metal-containing compound, and lubricant compositions containing same. The compositions reduce friction to a greater extent than lubricants containing no additive and, when placed in lubricating oils and used in an internal combustion engine, fuel consumption is reduced.

24 Claims, No Drawings

METAL-CONTAINING PRODUCTS OF PHOSPHOSULFURIZED AMIDES AND LUBRICANTS CONTAINING SAME

BACKGROUND OF THE INVENTION

1. Field of the Invention

The invention is concerned with a novel group of compounds and their use as friction reducing and antiwear additives in lubricants or fuels, i.e. lubricant or fuel compositions containing same.

2. Description of the Prior Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present therein.

Friction is also a problem any time two surfaces are in sliding or rubbing contact. It is of especial significance in an internal combustion engine, because loss of a substantial amount of the theoretical mileage possible from a gallon of fuel is traceable directly to friction.

Phosphorus compounds are known to be useful as additives to lubricants to improve some property thereof, e.g. the antiwear property. Further, lubricants containing metal salts of phosphorus acids are also known. However, no prior art is known disclosing or suggesting the reaction product of the present invention as a multifunctional antiwear, antioxidant, friction-reducing additive.

SUMMARY OF THE INVENTION

In accordance with the invention, there is provided a reaction product made by (1) reacting a phosphorus polysulfide, such as phosphorus pentasulfide, with a hydroxy aliphatic hydrocarbylamide of the formula

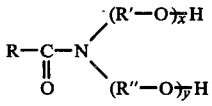

wherein R is a hydrocarbyl group containing 8 to 30 carbon atoms, R′ and R″ are $C_2$–$C_6$ aliphatic groups and x and y are 1 to 7 and (2) reacting this product with a metal-containing compound. Preferably, each of x and y is 1.

In this disclosure, hydrocarbyl includes alkyl, alkenyl, cycloalkyl, aralkyl and alkaryl where the aryl groups contain 6 to 14 carbon atoms. R′ and R″ may include such groups as ethyl, propyl, isopropyl, butyl, sec-butyl, isobutyl, pentyl, isopentyl and hexyl. Preferably R′ and R″ are ethyl groups.

The invention also provides a lubricant or liquid hydrocarbon fuel composition comprising a major proportion of a lubricant or fuel and a friction reducing amount of the reaction product.

DESCRIPTION OF THE SPECIFIC EMBODIMENTS

The novel compounds of this invention are made by (1) reacting phosphorus polysulfide, such as phosphorus pentasulfide, with an amide having the formula set forth hereinabove and (2) reacting the resulting product with a metal-containing compound. The product of the first reaction is a complex one perhaps containing many oligomers. Therefore, its precise structure is not known, although it may contain one or more of the following structures, illustrated with a bis-(2-hydroxyethyl) hydrocarbylamide.

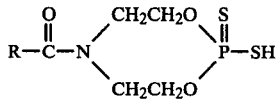

I.

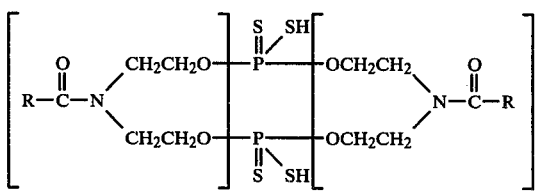

II.

These 2 structures would require 2 moles of the amide and 1 mole of $P_2S_5$.

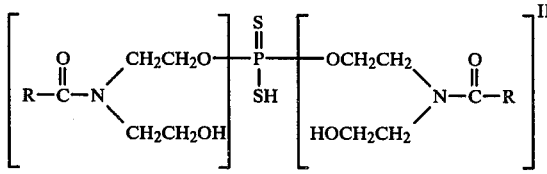

III.

Structure III would require 4 moles of amide per mole of $P_2S_5$. However, the amount of reactants in reaction (1) is not limited to the stated ratios. It is contemplated that in that reaction, from about 12 moles to about 2 moles of amide, preferably from about 4 moles to about 2 moles, can be used per mole of $P_2S_5$. Thus, we preferably phosphosulfurize a significant portion of the hydroxyl groups available for reaction. In order to obtain a significant benefit, at least 5 or 10% of the available groups must be phosphosulfurized. Up to equivalent amounts can be used, but phosphosulfurization of 30–75% of available hydroxyl groups is preferred. The temperature of this reaction can be within the range of from about 60° C. to about 140° C., preferably from about 90° C. to about 110° C.

Reaction (2) can be carried out at from about 50° C. to about 120° C., preferably from about 80° C. to about 100° C. Stoichiometric amounts of reagents may be used, or, if desired, a slight excess of about 1 to 5%. By "stoichiometric amounts" is meant sufficient amount of metal-containing compound to supply the required amount thereof to react with all the acid groups present in the complex product.

The metal-containing compound can be any of a variety of compounds, including salts. The metal cation can be broadly selected from Groups IB to VIII of the Periodic Table. Especially preferred are those from Group IIB, VIB and VIII, including zinc, molybdenum, nickel, cobalt and cadmium. The anion of the salt may be any of a number of radicals, including halide, nitrate and sulfate, oxide, hydroxide and carbonate.

While atmospheric pressure is generally preferred, either reaction can be advantageously run at from about 0.5 to about 2.0 atmospheres. Furthermore, where conditions warrant it, a solvent may be used. In general, reaction (1) can be run in the absence of solvent or in non-polar, unreactive solvent including benzene, toluene, xylene, heptane, or 1,4-dioxane. Reaction (2) can be run in any alcoholic solvent including isopropanol and n-butanol or in a mixture of polar and non-polar solvents, such as toluene and isopropanol. Small amounts of water can, if desired, be used to catalyze the reaction. The times of reactions for the reactants are not critical. Thus, any phase of the process can be carried out in from less than about 1 to 15 hours with agitation.

Most of the amides are commercially available or they may be made using known methods by reacting a bis(hydroxy aliphatic) amine with the appropriate aliphatic acid. For instance, a preferred amide, bis-(2-hydroxyethyl) hydrocarbylamide can be made by reaction of diethanolamine with the appropriate hydrocarbyl carboxylic acid.

Of particular significance, in accordance with the present invention, is the ability to improve the friction properties of oleaginous materials such as lubricating media which may comprise either a mineral oil or a synthetic oil, or a grease therefrom. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably, from about 50 to about 250 SSU at 210° F. These oils may have viscosity indexes ranging to about 100 or higher. Viscosity indexes from about 70 to about 95 are preferred. The average molecular weights of these oils may range from about 250 to about 800.

In instances where synthetic oils are desired in preference to mineral oils, or in combination therewith, various compounds of this type may be successfully utilized. Typical synthetic vehicles include polyisobutylene, polybutenes, hydrogenated polyolefins, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenol) ether, phenoxy phenylethers.

It is to be understood, however, that the compositions contemplated herein can also contain other materials. For example, corrosion inhibitors, extreme pressure agents, viscosity index improvers, detergents, dispersants, co-antioxidants, antiwear agents and the like can be used. These materials do not detract from the value of the compositions of this invention, but rather they serve to impart their customary properties to the particular compositions in which they are incorporated.

In general, the preformed adducts of the present invention may be employed in any amount which is effective for imparting the desired degree of friction reduction, anti-corrosion or antiwear activity. In many applications, however, the adduct is effectively employed in amounts from about 0.1% to about 10% by weight, and preferably from about 0.5 to about 5% of the total weight of the composition.

The following Examples will present illustrations of the invention. They are illustrative only, and are not meant to limit the invention.

EXAMPLE 1

N,N-(bis-2-hydroxyethyl)oleamide

Obtained commercially or made by reacting bis(2-hydroxyethyl)amine with oleic acid.

EXAMPLE 2

Phosphosulfurization of N,N-(bis-2-hydroxyethyl)oleamide

Approximately 150 g of N,N-(bis-2-hydroxyethyl-)oleamide was charged to a reaction flask equipped with stirrer, thermometer, condenser, and caustic scrubber. Approximately 16 g toluene was added and the mixture was heated to about 95° C. Over a period of 1 hour 23.1 g of phosphorus pentasulfide was added batchwise. The reaction mixture was held at 105° C. for 3 additional hours at which time no further $H_2S$ evolution was observed. The reaction solution was filtered through paper to remove the small amount (~0.5 g) of unreacted phosphorus pentasulfide. The resulting clear yellow solution was used for subsequent reactions.

EXAMPLE 3

Zinc salt of phosphosulfurized N,N-(bis-2-hydroxyethyl) oleamide

Approximately 85 g of phosphosulfurized N,N-(bis-2-hydroxyethyl)oleamide, prepared as described in Example 2, and 26.6 g zinc oxide were refluxed at 83° C. for 13 hours in 200 cc toluene and 200 cc isopropanol (containing a few drops of water) as solvents. The solvents were removed by vacuum distillation. The product was filtered through diatomaceous earth to yield a clear, yellow fluid.

EVALUATION OF THE COMPOUNDS

The additives of this invention are multifunctional. As the data hereinbelow show, they reduce friction, are antioxidants and are non-corrosive to copper. It is contemplated that they will also function as antiwear and bearing corrosion inhibitors. They are relatively stable in a thermal, oxidative and hydrolytic sense and have good solubility in most lubricant vehicles.

The compounds were evaluated in a low velocity friction apparatus (LVFA) in a fully formulated 5W-20 oil containing an additive package including antioxidant, dispersant, detergent and inhibitors. The friction reducing compound was 1-5% of the total weight of oil. Base oil had the following general characteristics:

Kinematic Viscosity
- @ 100° C.—6.8cs
- @ 40° C.—36.9cs

Viscosity Index
- 143

Description

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinetely variable-speed hydrualic transmission driven by a ½ HP electric motor. To vary the sliding speed, the output speed of the transmission is regulated by a lever-cam-motor arangement.

Procedure

The rubbing surfaces and 12–13 ml. of test lubricants are placed on the LVFA. A 240 psi load is applied, and the sliding speed is maintained at 40 fpm at ambient temperature for a few minutes. A plot of coefficients of friction ($U_k$) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 min. at 250° F., 240 pis, and 40 fpm sliding speed. Afterward, measurements of $U_k$ vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparision. The results were obtained at 250° F. and 500 psi.

TABLE 1

| | Friction Characteristics | | |
|---|---|---|---|
| | Additive Conc., | Reduction or % Change in Coefficient of Friction | |
| Example No. | Wt. % | 5 Ft./Min. | 30 Ft./Min. |
| 3 | 4 | 27 | 29 |
| Base Oil | 0 | 0[a] | 0[a] |

[a]Value for base fluid assigned as zero point.

The products were also evaluated for oxidation stability. In most cases improvements in oxidative stability over the base oil were observed. Basically the test lubricant is subjected to a stream of air which is bubbled through at the rate of 5 liters per hour at 425° F. for 24 hours. Present in the composition are samples of metals commonly used in engine construction, namely iron, copper, aluminum and lead. See U.S. Pat. No. 3,682,980, incorporated herein by reference, for further details of the test. Improvement in viscosity index or neutralization number (or both) show effective control. See the results in Table 2.

TABLE 2

| | Catalylic Oxidation Test 40 Hours @ 325° F. | | | |
|---|---|---|---|---|
| | Additive Conc., Wt., % | Lead, Loss, mg | Increase in Viscosity of Oxidized Oil Using KV @ 210° F. | Neut. Number NN |
| Base Oil, 0% additive 200" Solvent Paraffinic Neutral Lubricating Oil. | — | −1.2 | 67 | 3.62 |
| Example 3 | 1 | +0.8 | 19.7 | 1.97 |

TABLE 2-continued

| | Catalylic Oxidation Test 40 Hours @ 325° F. | | | |
|---|---|---|---|---|
| | Additive Conc., Wt., % | Lead, Loss, mg | Increase in Viscosity of Oxidized Oil Using KV @ 210° F. | Neut. Number NN |
| Zinc salt of phosphosulfurized N,N—(bis-2-hydroxyethyl) oleamide | | | | |

Also, copper strip corrosion tests were run in accordance with ASTM D130-6 and D130-9, the results of which are shown in Table 3.

TABLE 3

| | Copper Strip Corrosivity Characteristics | | |
|---|---|---|---|
| Example No. | Conc. in 200" SPN | ASTM D130-6 250° F. 3 Hrs. | ASTM D130-9 210° F. 6 Hrs. |
| 3 | 1 | 1A | 1A |

We claim:

1. A reaction product made by (1) reacting a phosphorus polysulfide with a compound of the formula

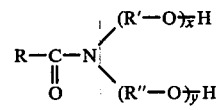

wherein R is a hydrocarbyl group containing 8 to 30 carbon atoms, R′ and R″ are $C_2$–$C_6$ aliphatic groups and x and y are 1 to 7, and (2) reacting this product with a metal-containing compound.

2. The product of claim 1 wherein R is alkyl, alkenyl, cycloalkyl, aralkyl or alkaryl, where "aryl" contains 6 to 14 carbon atoms.

3. The product of claim 1 wherein R′ and R″ are selected from ethyl, propyl, isopropyl, butyl, sec-butyl, isobutyl, pentyl, isopentyl or hexyl.

4. The product of claims 1, 2 or 3 wherein each of x and y is 1.

5. The product of claim 1 wherein the phosphorus polysulfide is phosphorus pentasulfide.

6. The product of claims 1, 2 or 3 wherein the metal in said metal-containing compound is selected from Groups IIB, VIB and VIII of the Periodic Table.

7. The product of claim 6 wherein the metal is zinc, molybdenum, nickel, cobalt or cadmium.

8. The product of claim 1 wherein the phosphorus polysulfide is phosphorus pentasulfide, R is oleyl, R′ and R″ are ethyl, each of x and y is 1 and the metal-containing compound is zinc oxide.

9. A composition comprising a major portion of a member of the group selected from a lubricant and a liquid fuel and from about 0.1% to about 10% by weight of a reaction product made by (1) reacting a phosphorus polysulfide with a compound of the formula

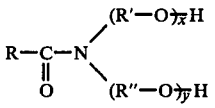

wherein R is a hydrocarbyl group containing 8 to 30 carbon atoms, R′ and R″ are $C_1$–$C_6$ aliphatic groups and x and y are 1 to 7, and (2) reacting this product with a metal-containing compound.

10. The composition of claim 9 wherein in said compound R is alkyl, alkenyl, cycloalkyl, aralkyl or alkaryl, where "aryl" contains 6 to 14 carbon atoms.

11. The composition of claim 9 wherein in said compound R′ and R″ are selected from ethyl, propyl, isopropyl, butyl, sec-butyl, isobutyl, pentyl, isopentyl or hexyl.

12. The composition of claims 9, 10 or 11 wherein each of x and y is 1.

13. The composition of claim 9 wherein the phosphorus polysulfide is phosphorus pentasulfide.

14. The composition of claim 10 wherein the phosphorus polysulfide is phosphorus pentasulfide.

15. The composition of claim 11 wherein the phosphorus polysulfide is phosphorus pentasulfide.

16. The composition of claim 12 wherein the phosphorus polysulfide is phosphorus pentasulfide.

17. The composition of claims 9, 10 or 11 wherein in said reaction product the metal in said metal-containing compound is selected from Groups IIB, VIB and VIII of the Periodic Table.

18. The composition of claim 17 wherein the metal is zinc, molybdenum, nickel, cobalt or cadmium.

19. The composition of claim 9 wherein in making the reaction product phosphorus pentasulfide is reacted with a compound in which R is oleyl, R′ and R″ are ethyl and each of x and y is 1.

20. The composition of claim 9 wherein said lubricant is a lubricating oil.

21. The composition of claim 9 wherein said lubricant is a grease.

22. The composition of claim 20 wherein said lubricating oil is a mineral oil.

23. The composition of claim 22 wherein said lubricating oil is a synthetic oil.

24. The composition of claim 22 wherein said lubricating oil is a mixture of synthetic and mineral oils.

* * * * *